US012138743B2

(12) United States Patent
Kang

(10) Patent No.: US 12,138,743 B2
(45) Date of Patent: Nov. 12, 2024

(54) POLISHING DEVICE

(71) Applicants: XI'AN ESWIN MATERIAL TECHNOLOGY CO., LTD., Xi'an (CN); XI'AN ESWIN SILICON WAFER TECHNOLOGY CO., LTD., Xi'an (CN)

(72) Inventor: Yong Kang, Xi'an (CN)

(73) Assignees: XI'AN ESWIN MATERIAL TECHNOLOGY CO., LTD., Xi'an (CN); XI'AN ESWIN SILICON WAFER TECHNOLOGY CO., LTD., Xi'an (CN)

( * ) Notice: Subject to any disclaimer, the term of this patent is extended or adjusted under 35 U.S.C. 154(b) by 1072 days.

(21) Appl. No.: 16/918,617

(22) Filed: Jul. 1, 2020

(65) Prior Publication Data

US 2021/0086323 A1 Mar. 25, 2021

(30) Foreign Application Priority Data

Sep. 19, 2019 (CN) ..... 201910887203.X

(51) Int. Cl.
*B24B 9/06* (2006.01)
*B24B 41/04* (2006.01)
*B24B 41/06* (2012.01)

(52) U.S. Cl.
CPC ..... *B24B 9/065* (2013.01); *B24B 41/04* (2013.01); *B24B 41/06* (2013.01)

(58) Field of Classification Search
CPC ..... B24B 9/065; B24B 41/04; B24B 41/06; B24B 47/12; B24B 27/0076;
(Continued)

(56) References Cited

U.S. PATENT DOCUMENTS 2,507,547 A * 5/1950 Shephard ..... B23C 3/08 409/165
4,344,260 A * 8/1982 Ogiwara ..... B24B 9/065 257/E21.237

(Continued)

FOREIGN PATENT DOCUMENTS

CN 201186404 Y 1/2009
CN 104924169 A * 9/2015 ..... B24B 27/0076

(Continued)

OTHER PUBLICATIONS

English Translation of CN 104924169 A (Year: 2015).*

(Continued)

*Primary Examiner* — Robert F Neibaur
(74) *Attorney, Agent, or Firm* — Maginot, Moore & Beck LLP

(57) ABSTRACT

A polishing device includes a bearing mechanism including a bearing plate configured to carry wafers and drive the wafer to rotate and a first polishing mechanism including at least one group of rotatable first polishing wheels. Each first polishing wheel is formed with a first polishing groove extending along a circumferential direction. Each group includes two first polishing wheels. The two first polishing wheels in each group are arranged symmetrically with respect to the bearing plate and rotation axes of the two first polishing wheels are coplanar with a rotation axis of the bearing plate. The two first polishing wheels in each group are capable of moving close to or away from the wafer, so that an inner sidewall of the first polishing groove is pressed against or moves away from the wafer.

7 Claims, 2 Drawing Sheets

(58) Field of Classification Search
CPC ..... B24B 27/0092; B24B 27/0082; B24B 27/0023; Y10T 74/1967
USPC ..... 74/422; 451/210
See application file for complete search history.

(56) References Cited

U.S. PATENT DOCUMENTS

| | | | | | |
|---|---|---|---|---|---|
| 5,097,630 | A * | 3/1992 | Maeda | B24B 9/065 | 451/143 |
| 5,658,189 | A * | 8/1997 | Kagamida | B24B 41/02 | 451/194 |
| 5,944,584 | A * | 8/1999 | Toyama | B24B 9/065 | 451/41 |
| 6,045,436 | A * | 4/2000 | Rieger | B24B 9/065 | 451/41 |
| 6,261,160 | B1 * | 7/2001 | Hakomori | B23Q 39/046 | 451/210 |
| 6,428,397 | B1 * | 8/2002 | Stocker | B24B 55/04 | 451/146 |
| 6,478,660 | B2 * | 11/2002 | Hakomori | B24B 27/0076 | 451/43 |
| 6,604,896 | B2 * | 8/2003 | Feldman | B23Q 7/02 | 409/166 |
| 7,189,149 | B2 * | 3/2007 | Katayama | B24B 9/065 | 451/443 |
| 7,993,485 | B2 * | 8/2011 | Wasinger | B24B 21/004 | 156/345.12 |
| 8,398,464 | B2 * | 3/2013 | Kim | B24B 53/07 | 451/285 |
| 10,010,992 | B2 * | 7/2018 | Xue | B24B 5/40 | |
| 2013/0264584 | A1 * | 10/2013 | Okita | H01L 29/1608 | 257/77 |

FOREIGN PATENT DOCUMENTS

| | | | | | |
|---|---|---|---|---|---|
| CN | 205147988 | U | | 4/2016 | |
| CN | 106239340 | A | * | 12/2016 | |
| CN | 206912841 | U | | 1/2018 | |
| CN | 107650001 | A | | 2/2018 | |
| CN | 108247447 | A | * | 7/2018 | B24B 27/0076 |
| CN | 207953405 | U | | 10/2018 | |
| CN | 208132625 | U | | 11/2018 | |
| CN | 109623553 | A | | 4/2019 | |
| CN | 114102411 | A | * | 3/2022 | |
| JP | 4307674 | B2 | | 8/2009 | |
| KR | 20130090350 | A | * | 8/2013 | B24B 9/08 |

OTHER PUBLICATIONS

English Translation of CN 106239340 A (Year: 2016).*
English Translation of CN 108247447 A (Year: 2018).*
Machine translation of KR-20130090350-A (Year: 2013).*
Machine translation of CN-114102411-A (Year: 2022).*
Chinese IPO Office Action in related case CN 201910887203X.

* cited by examiner

POLISHING DEVICE

CROSS-REFERENCE TO RELATED APPLICATION

This application claims a priority to Chinese Patent Application No. 201910887203.X filed on Sep. 19, 2019, the disclosures of which are incorporated in their entirety by reference herein.

TECHNICAL FIELD

The invention relates to the field of wafer processing, in particular, to a polishing device.

BACKGROUND

Generally, the edge of a wafer after being subjected to wire cut electrical discharge machining is sharp. If it is observed in minute detail, there will be fine debris in the edge, which will cause cracks and breakage of the wafer when the next process is performed. In addition, the outer diameter of the ingot before being subjected to the wire cut electrical discharge machining is about 0.5 to about 1.0 mm greater than the final outer diameter. For this reason, the edge polishing process will use a polishing wheel with grinding particles having a certain particle size to polish the edge surface in order to remove its damage and process into a wafer with an outer diameter having the desired size. However, a common method suitable for performing polishing uses the edge of one polishing wheel with grinding particles having a certain particle size. Thus, there is more silicon material removed in such method, and it will take a relatively long time for performing polishing. When the polishing process is performed only on one side of a wafer, it has low efficiency for polishing the wafer. Moreover, due to vibrations of the wafer or the polishing wheel relative to each other, deviations in the wafer polishing process are likely to occur. In addition, debris may occur due to uneven processing load such as flutter at the edge of the wafer. As a result, both the processing accuracy and the quality of the wafer will be reduced.

SUMMARY

In view of this, the present disclosure provides a polishing device to solve the above problem that the processing accuracy of the wafer is reduced due to wafer vibration and uneven processing load during wafer polishing.

To solve the above technical problem, the present disclosure adopts the following technical solutions.

A polishing device according to an embodiment of the present disclosure includes a bearing mechanism including a bearing plate configured to carry a wafer and drive the wafer to rotate, and a first polishing mechanism including at least one group of rotatable first polishing wheels. Each first polishing wheel is formed with a first polishing groove extending along a circumferential direction. Each of the at least one group of rotatable first polishing wheels includes two of the first polishing wheels. The two first polishing wheels in each group are arranged symmetrically with respect to the bearing plate and rotation axes of the two first polishing wheels are coplanar with a rotation axis of the bearing plate. The two first polishing wheels in each group are capable of moving close to or away from the wafer so that an inner sidewall of each first polishing groove is pressed against or moves away from the wafer.

Alternatively, the bearing mechanism includes a bearing plate configured to drive the wafer to rotate, and a driving motor connected to the bearing plate to drive the bearing plate to rotate.

Alternatively, the first polishing mechanism includes at least one group of first motors, wherein each of the at least one group of first motors includes two first motors, and the two first polishing wheels in each group of rotatable first polishing wheels are respectively connected to the two first motors in each group of first motors to allow the first motors to drive the first polishing wheels to rotate.

Alternatively, the polishing device further includes: at least one group of first driving mechanisms, in which the first driving mechanisms in each group of the first driving mechanisms are connected to the two first motors in each group of first motors respectively to drive the first polishing wheel toward or away from the wafer.

Alternatively, each group of the first driving mechanisms includes: two first racks arranged in parallel to each other, in which the two first motors in each group of first motors are arranged on corresponding first racks respectively; a first gear arranged between the two first racks and engaging with the two first racks respectively, in which the first gear drives the two first racks to move the two first polishing wheels towards or away from the wafer when the first gear rotates; a first driving part connected to the first gear to drive the first gear to rotate.

Alternatively, the polishing device further includes: a second polishing mechanism including at least one group of rotatable second polishing wheels, in which each second polishing wheel is formed with a second polishing groove extending along a circumferential direction, the second polishing groove differs from the first polishing groove, each of the at least one group of rotatable second polishing wheels includes two second polishing wheels, the two second polishing wheels in each group are arranged symmetrically with respect to the bearing plate and rotation axes of the two second polishing wheels are coplanar with a rotation axis of the bearing plate, and the two second polishing wheels in each group are capable of moving closer to or away from the wafer so that an inner sidewall of each second polishing groove is pressed against or moves away from the wafer.

Alternatively, the second polishing mechanism includes: at least one group of second motors, in which each of the at least one group of second motors includes two second motors, and the two second polishing wheels in each group of rotatable second polishing wheels are respectively connected to the two second motors in each group of second motors to allow the second motors to drive the second polishing wheels to rotate.

Alternatively, the polishing device further includes: at least one group of second driving mechanisms, in which the second driving mechanisms in each group of the second driving mechanisms are connected to the two second motors in each group of second motors respectively to drive the second polishing wheel toward or away from the wafer.

Alternatively, each group of the second driving mechanisms includes: two second racks arranged in parallel to each other, in which two second motors in each group of second motors are arranged on corresponding second racks respectively; a second gear arranged between the two second racks and engaging with the two second racks respectively, in which the second gear drives the two second racks to move the two second polishing wheels towards or away from the wafer when the second gear rotates; and a second driving part connected to the second gear to drive the second gear to rotate.

Alternatively, the first polishing wheel and the second polishing wheel are arranged at regular intervals along a circumferential direction of the wafer.

The advantageous effects of the above technical solutions of the present disclosure are shown as follows:

The polishing device according to the embodiment of the present disclosure, a first polishing mechanism includes at least one group of rotatable first polishing wheels, in which each first polishing wheel is formed with a first polishing groove extending along a circumferential direction, each of the at least one group of rotatable first polishing wheels includes two first polishing wheels, the two first polishing wheels in each group are arranged symmetrically with respect to the bearing plate and rotation axes of the two first polishing wheels are coplanar with a rotation axis of the bearing plate, and the two first polishing wheels in each group are capable of moving towards or away from the wafer so that an inner sidewall of each first polishing groove is pressed against or moves away from the wafer. The wafers are polished by the first polishing grooves on the two first polishing wheels arranged symmetrically. Thus the polishing device according to the embodiments of the present disclosure is capable of maintaining the stable balance of the wafer during the polishing process, reducing the vibration of the wafer, improving the processing precision of the wafer, and accelerating the polishing efficiency. Further, the polishing quality of the wafer is improved.

Figure 1:
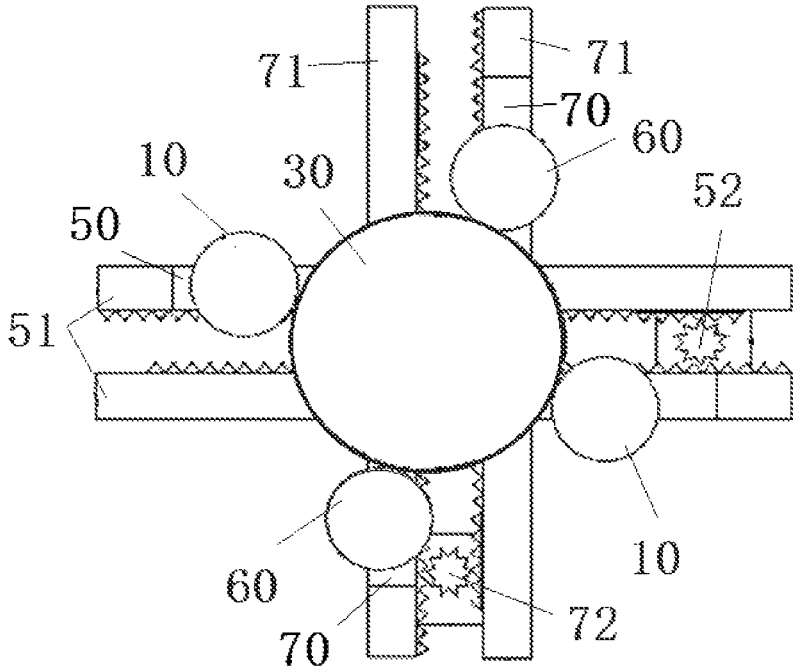
FIG. 1 is a schematic view showing a polishing device according to an embodiment of the present disclosure.

REFERENCE NUMBERS first polishing wheel 10;
bearing plate 20;
wafer 30;
driving motor 40;
first motor 50; first rack 51; first gear 52; first driving part 53;
second polishing wheel 60;
second motor 70; second rack 71; second gear 72.

DETAILED DESCRIPTION

In order to illustrate the purposes, technical solution and advantages in the embodiments of the present disclosure in a clearer manner, the technical solutions in the embodiments of the present disclosure will be described hereinafter in conjunction with the drawings in the embodiments of the present disclosure in a clear and complete manner. Obviously, the following embodiments relate to some of, rather than all of, the embodiments of the present disclosure. Based on the described embodiments of the present disclosure, a person skilled in the art may obtain the other embodiments, which also fall within the scope of the present disclosure.

The polishing device according to an embodiment of the present disclosure will be specifically described hereafter in conjunction with the drawings.

A polishing device according to the embodiment of the present disclosure includes a bearing mechanism and a first polishing mechanism.

Figure 2:
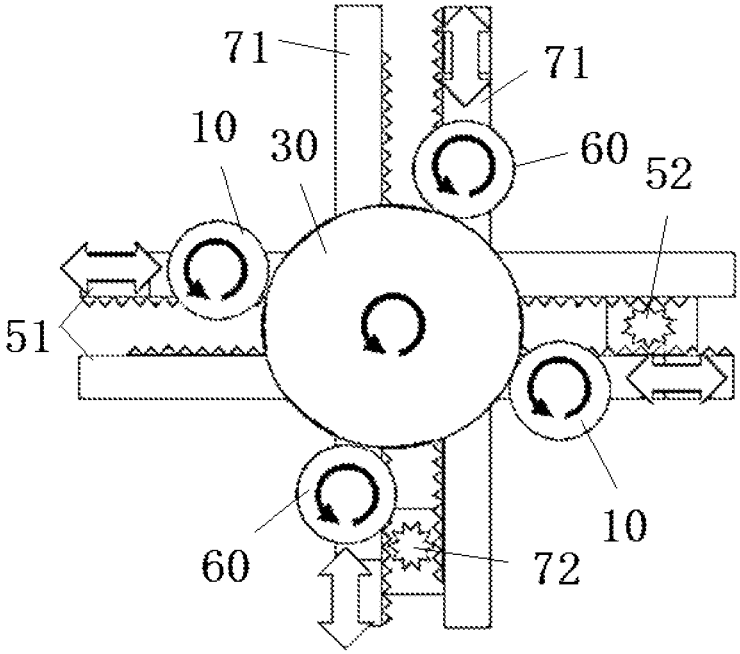
FIG. 2 is a schematic view showing a polishing device according to another embodiment of the present disclosure.
Figure 3:
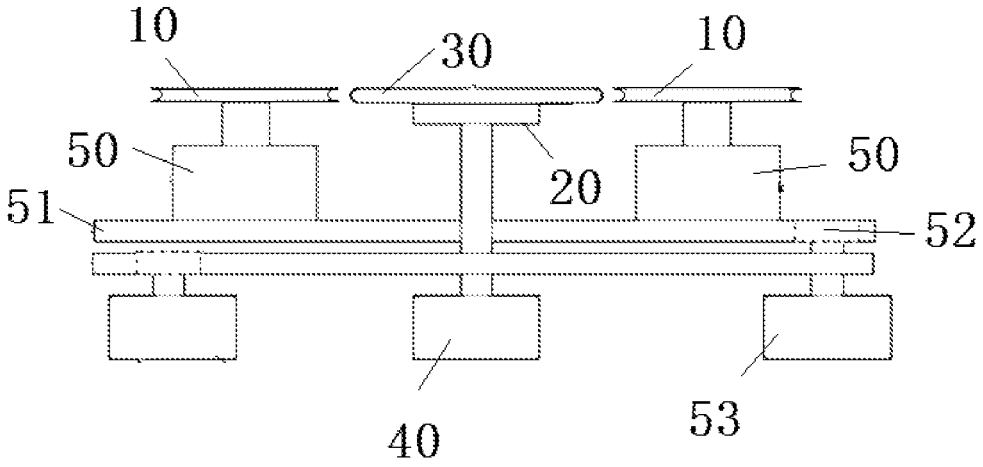
FIG. 3 is a schematic view showing a polishing device according to still another embodiment of the present disclosure.

Specifically, as shown in FIGS. 1 to 3, the bearing mechanism is used to bear the wafer, and a first polishing mechanism includes at least one group of rotatable first polishing wheels 10. Each first polishing wheel 10 is formed with a first polishing groove extending along a circumferential direction, each of the at least one group of rotatable first polishing wheels includes two first polishing wheels 10. The two first polishing wheels 10 in each group are arranged symmetrically with respect to the wafer 30 or the bearing plate 20 and rotation axes of the two first polishing wheels 10 are coplanar with an axis of the wafer 30 or the bearing plate 20. The two first polishing wheels 10 in each group are capable of moving close to or away from the wafer 30 so that an inner sidewall of each first polishing groove is pressed against or moves away from the wafer 30.

That is to say, the bearing mechanism can be used to carry wafers, and can drive the wafer 30 to rotate. The first polishing mechanism may include at least one group of rotatable first polishing wheels 10. For example, it can include two groups. A first polishing groove may be formed on the first polishing wheel 10, and the inner sidewall of the first polishing groove may be provided with uniformly distributed abrasive particles. The wafer 30 may be polished by the abrasive particles, and the wafer 30 may be rough polished by the first polishing groove. The first polishing groove may extend along the circumferential direction of the first polishing wheel 10. Each group may include two first polishing wheels 10. The two first polishing wheels 10 in each group are arranged symmetrically with respect to the wafer 30 or the bearing plate 20, and the rotation axes of the two first polishing wheels 10 are coplanar with the rotation axis of the wafer 30 or the bearing plate 20 so that forces applied on the wafer 30 by the first polishing wheels 10 in each group are balanced, and the vibration of the wafer 30 is reduced when the wafer is polished, and thus the polishing accuracy of the wafer 30 is improved.

The two first polishing wheels 10 in each group can be close to or far away from the wafer 30 so that the inner sidewall of the first polishing groove is pressed against or away from the wafer 30. The first polishing wheel 10 can be connected to a driving mechanism, and can drive the two first polishing wheels 10 in each group to move close to or away from the wafer 30 by driving the first grinding wheel 10 to rotate through the driving mechanism. When the two first polishing wheels 10 in each group move close to the wafer 30, the inner sidewall can be pressed against the wafer, and the wafer 30 can be polished by the rotation of the first polishing wheel 10. After the polishing, the two first polishing wheels 10 in each group can move away from the wafer 30, and the inner sidewall of the first polishing groove can move away from the wafer 30 to take the wafer 30 out of the first polishing groove. According to the polishing device of the embodiment of the present disclosure, the wafers are polished by the first polishing grooves on the two first polishing wheels 10 arranged symmetrically, which is capable of maintaining the stable balance of the wafer 30 during the polishing process, reducing the vibration of the wafer 30, improving the processing precision of the wafer 30, accelerating the polishing efficiency and improving the polishing quality of the wafer 30. The polishing device in the present disclosure can process the edge of the wafer 30 which has been subjected to the wire cutting, and thus it is suitable for the cut wafer. The first polishing wheel 10 according to an embodiment of the present disclosure can include diamond or cubic boron nitride as abrasive particles, and can include a binder suitable for binding metal, resin, ceramic, and the like. In addition, this polishing device can be suitable for polishing the cut silicon wafer, and also for polishing other semiconductor wafers such as GaAs, GaN, and GaP wafers.

In some embodiments of the present disclosure, the bearing mechanism may include a bearing plate 20 and a driving motor 40. The bearing plate 20 may be used to drive the wafer 30 to rotate, and the driving motor 40 is connected to the bearing plate 20 to drive the bearing plate 20 to rotate. During the polishing process, the edge portion of the wafer is placed in the first polishing groove of the first polishing wheel 10, and the first polishing wheel 10 rotates to polish the wafer 30. At the same time, the bearing plate 20 can also drive the wafer 30 to rotate, so as to uniformly polish the wafer 30 and improve the polishing quality and efficiency of the wafer 30.

In other embodiments of the present disclosure, as shown in FIGS. 1 and 3, the first polishing mechanism may include at least one group of first motors 50, and each of the at least one group of first motors includes two first motors 50. The two first polishing wheels 10 in each group of rotatable first polishing wheels are respectively connected to the first motors 50 in each group of first motors, so that the first motor 50 drives the first polishing wheels 10 to rotate. That is, each first polishing wheel 10 is connected to one corresponding first motor 50, and the first polishing wheel 10 is driven to rotate by the first motor 50 connected to the first polishing wheel 10.

In an embodiment of the present disclosure, the polishing device may further include at least one group of first driving mechanisms. The first driving mechanisms in each group of the first driving mechanisms may be respectively connected to the two first motors 50 in each group of first motors to drive the first polishing wheel 10 toward or away from the wafer. The first driving mechanisms in each group of first driving mechanisms may be connected to two first motors 50 in each group of first motors to drive the two first motors 50 to move, thereby driving the first polishing wheel 10 toward or away from the wafer.

According to some embodiments of the present disclosure, as shown in FIGS. 1 to 3, each group of the first driving mechanism may include: two first racks 51 arranged in parallel with each other, a first gear 52, and a first driving part 53. The two first motors 50 in each group are arranged on the corresponding first rack 51, that is, each first rack 51 is provided with a first motor 50. The first gear 52 is arranged between the two first racks 51, and the first gear 52 engages with the two first racks 51 respectively. When the first gear 52 rotates, the two first racks 51 are driven to move the two first polishing wheels 10 towards or away from the wafer. The first driving part 53 may be connected to the first gear 52 to drive the first gear 52 to rotate. The first driving part 53 may be a motor. The two first polishing wheels 10 move the two first polishing wheels 10 towards or away from the wafer through the movement of the two first racks 51. Thus, the two first polishing wheels 10 can be maintained stable and symmetrical during the movement, and can be close to or away from the wafer 30 at the same time. Therefore, it can be convenient to maintain the balance during the wafer polishing process and improve the polishing quality of the wafer 30.

In some embodiments of the present disclosure, as shown in FIGS. 1 and 2, the polishing device may further include a second polishing mechanism, and the second polishing mechanism may include at least one group of rotatable second polishing wheels 60. A second polishing groove extending along the circumference of the second polishing wheel 60 may be formed on second polishing wheels 60. The second polishing groove is different from the first polishing groove, and the roughness of the inner sidewall of the second polishing groove may be smaller than the roughness of the inner sidewall of the first polishing groove. For example, the second polishing groove with an inner sidewall having small roughness can be used for fine polishing of the wafer 30; and the first polishing groove with an inner sidewall having large roughness can be used for rough polishing of the wafer. Each group may include two second polishing wheels 60. The two second polishing wheels 60 in each group are arranged symmetrically with respect to the wafer 30 or the bearing plate 20 and rotation axes of the two second polishing wheels 60 are coplanar with a rotation axis of the wafer 30 or the bearing plate 20. The two second polishing wheels 60 in each group are capable of moving close to or away from the wafer 30 so that an inner sidewall of each second polishing groove is pressed against or moves away from the wafer 30. The force applied by the second polishing wheels 60 in each group is balanced when the wafer is polished, and thus the vibration of the wafer 30 is reduced, and the polishing accuracy of the wafer 30 is improved. The two second polishing wheels 60 in each group can be close to or far away from the wafer 30 so that the inner sidewall of the second polishing groove is pressed against or away from the wafer 30. The second polishing wheels 60 can be connected to the driving mechanisms, and can drive the two second polishing wheels 60 in each group to move close to or away from the wafer 30 by driving the second grinding wheel 60 to rotate through the driving mechanisms. When the two second polishing wheels 60 in each group move close to the wafer 30, the inner sidewall can be pressed against the wafer, and the wafer can be polished by the rotation of the second polishing wheel 60. After the polishing, the two second polishing wheels 60 in each group can move away from the wafer 30, and the inner sidewall of the second polishing groove can move away from the wafer to take the wafer out of the polishing groove.

The wafers are polished by different first polishing wheels 10 and second polishing wheels 60. The center of the wafer 30 is set before polishing to perform center positioning. Both the first polishing wheels 10 and the second polishing wheels 60 are provided on the same device. After the first polishing wheels 10 are used for the first polishing on the wafer 30, there is no need to transfer the wafer 30, and the second polishing wheels 60 are directly used to perform the second polishing on the wafer 30. Thus, errors are avoided during the second transfer of the wafer. Moreover, there is no need to reposition the wafer 30 so that the wafer 30 is in the same positioning center during the second polishing, thereby improving the grinding accuracy of the wafer 30.

Optionally, as shown in FIG. 1, the second polishing mechanism may include at least one group of second motors 70, and each group may include two second motors 70. The two second polishing wheels 60 in each group of rotatable second polishing wheels are respectively connected to the second motors 70 in each group of second motors. That is, one second polishing wheel 60 is connected to a corresponding second motor 70 so that the second motor 70 drives the second polishing wheel 60 to rotate.

In some embodiments, the polishing device may further include at least one group of second driving mechanisms. The second driving mechanisms in each group of the second driving mechanisms are respectively connected to the two second motors 70 in each group of second motors to drive the second polishing wheel 60 toward or away from the wafer 30. The second driving mechanisms in each group of second driving mechanisms may be connected to the two second motors 70 in each group of second motors to drive the two second motors 70 to move, thereby driving the second polishing wheel 60 toward or away from the wafer 30.

According to some embodiments, as shown in FIGS. 1 to 2, each group of the second driving mechanism may include: two second racks 71 arranged in parallel with each other, a second gear 72, and a second driving part 53. The two second motors 70 in each group are arranged on the corresponding second racks 71 respectively. Each second rack 71 is provided with a second motor 70. The second gear 72 is arranged between the two second racks 71, and the second gear 72 engages with the two second racks 71 respectively. When the second gear 72 rotates, the two second racks 71 are driven to move the two second polishing wheels 60 towards or away from the wafer 30. The second driving part may be a motor. The second driving part may be connected to the second gear 72 to drive the second gear 72 to rotate. The two second polishing wheels 60 moves the two second polishing wheels 60 towards or away from the wafer through the movement of the two first racks 71, so that the two second polishing wheels 10 can be maintained stable and symmetrical during the movement, and can be close to or away from the wafer at the same time. This is convenient to maintain the balance during the wafer polishing process and improve the polishing quality of the wafer 30. Since wafer processing is performed by one-time center positioning, measurement errors that may occur due to the re-measurement of the outer diameter of the wafer are reduced, thereby improving the processing precision and shortening the working time. In the embodiments of the present disclosure, the diameter of the polishing wheel is smaller than that when one polishing wheel is used, thereby the load for driving the polishing wheel can be reduced and the vibration of the polishing wheel can be suppressed. Moreover, the balance of the processing load is maintained by machining with a pair of polishing wheels arranged symmetrically.

In some embodiments of the present disclosure, the first polishing wheels 10 and the second polishing wheels 60 may be evenly spaced along the circumferential direction of the wafer, respectively, so that the first polishing wheels 10 and the second polishing wheels 60 maintain the balance and stability of the wafer 30 when the wafer 30 is polished, and the polishing accuracy of the wafer 30 is improved.

Unless otherwise defined, technical terms or scientific terms used herein have the normal meaning commonly understood by one skilled in the art in the field of the present disclosure. The words "first", "second", and the like used in the present disclosure do not denote any order, quantity, or importance, but rather merely serves to distinguish different components. The word "connected" or "connecting" and the like are not limited to physical or mechanical connections, but may include electrical connections, whether direct or indirect. "On", "under", "left", "right" and the like are only used to represent relative positional relationships, and when the absolute position of the described object is changed, the relative positional relationship may also be changed, accordingly.

The above descriptions are preferred embodiments of the present disclosure. It should be noted that one skilled in the art would make several improvements and substitutions without departing from the principles of the present disclosure. These improvements and modifications should also be regarded as the protection scope of the present disclosure.

What is claimed is:

1. A polishing device, comprising:

a bearing mechanism comprising a bearing plate configured to carry a wafer and drive the wafer to rotate; and a first polishing mechanism comprising at least one group of rotatable first polishing wheels, wherein each of the first polishing wheels is formed with a first polishing groove extending along a circumferential direction, each of the at least one group of rotatable first polishing wheels comprises two identical first polishing wheels which are formed with identical first polishing grooves extending along the circumferential direction, the two identical first polishing wheels in each group are arranged symmetrically with respect to the bearing plate and rotation axes of the two identical first polishing wheels are coplanar with a rotation axis of the bearing plate, and the two identical first polishing wheels in each group are capable of simultaneously moving close to or away from the wafer so that an inner sidewall of each first polishing groove is simultaneously pressed against or moves away from the wafers, wherein the first polishing mechanism further comprises at least one group of first motors and each of the at least one group of first motors comprises two first motors, and the two identical first polishing wheels in each group of rotatable first polishing wheels are respectively connected to the two first motors in each group of first motors to allow the first motors to drive the two identical first polishing wheels to rotate, the polishing device further comprising at least one group of first driving mechanisms, and the first driving mechanisms in each group of the first driving mechanisms are connected to the two first motors in each group of first motors respectively to simultaneously drive the two identical first polishing wheels toward or away from the wafer, and wherein each group of the first driving mechanisms comprises:

two first racks arranged in parallel orientation with each of the other first rack, wherein the two first motors in each group of first motors are arranged on the first racks respectively;

a first gear arranged between the two first racks and engaging with the two first racks, wherein the first gear drives the two first racks to move the two identical first polishing wheels towards or away from the wafer when the first gear rotates; and a first driving part connected to the first gear to drive the first gear to rotate.

2. The polishing device of claim 1, wherein the bearing mechanism comprises:

a driving motor connected to the bearing plate to drive the bearing plate to rotate.

3. The polishing device of claim 1, further comprising: a second polishing mechanism comprising at least one group of rotatable second polishing wheels, wherein each of the second polishing wheels is formed with a second polishing groove extending along a circumferential direction, the second polishing groove differs from the first polishing groove, each of the at least one group of rotatable second polishing wheels comprises two identical second polishing wheels which are formed with identical second polishing grooves extending along the circumferential direction, the two identical second polishing wheels in each group are arranged symmetrically with respect to the bearing plate and rotation axes of the two identical second polishing wheels are coplanar with a rotation axis of the bearing plate, and the two identical second polishing wheels in each group are capable of simultaneously moving close to or away from the wafer so that an inner sidewall of the second polishing groove is simultaneously pressed against or moves away from the wafer.

4. The polishing device of claim 3, wherein the second polishing mechanism comprises: at least one group of second motors, wherein each of the at least one group of second motors comprises two second motors, and the two identical second polishing wheels in each group of rotatable second polishing wheels are respectively connected to the two second motors in each group of second motors to allow the second motors to drive the two identical second polishing wheels to rotate.

5. The polishing device of claim 4, further comprising: at least one group of second driving mechanisms, wherein the second driving mechanisms in each group of the second driving mechanisms are connected to the two second motors in each group of second motors respectively to simultaneously drive the two identical second polishing wheels toward or away from the wafer.

6. The polishing device of claim 5, wherein each group of the second driving mechanisms comprises: two second racks arranged in parallel orientation with each of the other second rack wherein the two second motors in each group of second motors are arranged on the second racks respectively; a second gear arranged between the two second racks and engaging with the two second racks, wherein the second gear drives the two second racks to move the two identical second polishing wheels towards or away from the wafer when the second gear rotates; and a second driving part connected to the second gear to drive the second gear to rotate.

7. The polishing device of claim 3, wherein the first polishing wheels and the second polishing wheels are arranged at regular intervals along a circumferential direction of the wafer.

* * * * *